US011097199B2

(12) United States Patent
Richardson et al.

(10) Patent No.: US 11,097,199 B2
(45) Date of Patent: Aug. 24, 2021

(54) DEVICES AND METHODS FOR HOLOGRAPHIC SCREEN SUSPENSION SYSTEMS

(71) Applicant: PRISM HOLOGRAMS LLC, Los Angeles, CA (US)

(72) Inventors: David Richardson, Los Angeles, CA (US); Ryan Richardson, Northridge, CA (US)

(73) Assignee: PRISM HOLOGRAMS LLC, Los Angeles, CA (US)

( * ) Notice: Subject to any disclaimer, the term of this patent is extended or adjusted under 35 U.S.C. 154(b) by 103 days.

(21) Appl. No.: 16/678,890

(22) Filed: Nov. 8, 2019

(65) Prior Publication Data

US 2020/0147512 A1 May 14, 2020

Related U.S. Application Data

(60) Provisional application No. 62/758,463, filed on Nov. 9, 2018.

(51) Int. Cl.

| | |
|---|---|
| ***A63J 5/02*** | (2006.01) |
| ***E04G 3/22*** | (2006.01) |
| ***E04H 3/22*** | (2006.01) |

(52) U.S. Cl.

CPC . *A63J 5/02* (2013.01); *E04H 3/22* (2013.01)

(58) Field of Classification Search

CPC ..... G02B 30/00; G02B 30/56; H04N 13/363; G03H 2270/11; G03H 2210/30

See application file for complete search history.

(56) References Cited

U.S. PATENT DOCUMENTS

| | | | | |
|---|---|---|---|---|
| 5,924,870 | A | 7/1999 | Brosch et al. | |
| 6,237,264 | B1 | 5/2001 | Gulick, Jr. | |
| 9,625,732 | B1 * | 4/2017 | Laduke | G02B 30/56 |
| 9,989,777 | B1 * | 6/2018 | Comploi | G09G 3/003 |
| 2005/0264560 | A1 | 12/2005 | Hartkop et al. | |
| 2006/0171008 | A1 | 8/2006 | Mintz et al. | |
| 2007/0153375 | A1 * | 7/2007 | Peterson | G03B 21/56 359/443 |
| 2009/0316260 | A1 * | 12/2009 | Howes | B29C 66/4722 359/443 |
| 2011/0002020 | A1 | 1/2011 | Khan | |
| 2013/0050184 | A1 | 2/2013 | Song | |
| 2014/0026384 | A1 * | 1/2014 | Baker | A63G 31/00 29/428 |

FOREIGN PATENT DOCUMENTS

WO 2015140578 A1 9/2015

OTHER PUBLICATIONS

Webpage extracted Dec. 28, 2020: https://hypervsn.com.

International Search Report and Written Opinion for PCT/US20/039006, dated Oct. 14, 2020.

* cited by examiner

*Primary Examiner* — Gisele D Ford

(74) *Attorney, Agent, or Firm* — Robert R. Riddle; Hallie H. Wimberly; Reed Smith LLP

(57) ABSTRACT

The present disclosure provides devices and methods for holographic screen suspension systems. These systems can allow for a smooth reflection surface of the screen that is void of wrinkled or non-uniform surfaces.

14 Claims, 8 Drawing Sheets

DEVICES AND METHODS FOR HOLOGRAPHIC SCREEN SUSPENSION SYSTEMS

CROSS-REFERENCE TO RELATED APPLICATIONS

The present application claims priority to U.S. Provisional Application 62/758,463, filed Nov. 9, 2018, the entirety of which is incorporated herein by reference.

BACKGROUND

Live performance hologram illusions, also known as "Pepper's Ghost Illusion," are a desired and crowd-pleasing spectacle for concerts, theme or amusement parks, business motivational speakers, celebrity presenters and the like.

Pepper's ghost is an illusionary technique used by magicians, by ride or attraction designers, and others to produce a 3D illusion of a latent or ghost-like image by reflecting a hidden image source onto a semi-transparent screen. Using a simple piece of plate glass and special lighting techniques, Pepper's ghost systems can make objects appear and disappear within a scene or room. In turn, the achieved result is a reflected image or object that appears to the audience as if it were in 3D space.

Generally, main components of such a system include, for example, (i) a bounce screen or an image source; (ii) a semi-transparent and reflective screen angled at about 45 degrees directly above or below the bounce screen; and (iii) a backdrop or stage to create the space for the illusion. The bounce screen is usually hidden on the ground or above the audience. The bounce screen can either receive an image from a projector, or forego the projector and be replaced with an LED, LCD or TV-like display system.

Conventionally, such systems employ at least one "ratchet strap" for securely engaging a screen. Generally, such ratchet straps connect the main structure (usually stage trusses) to the screen. The transparent screen is grabbed onto by two sandwiching members referred to as "screen brace". The screen brace can be two extruded rectangular bars of aluminum. Such orientation or configuration allows for multiple points along the screen brace to be independently or asymmetrically adjusted via the ratchet straps as they may be tightened or loosened independent of each other. Tightening or loosening of ratchet straps may be achieved by a friction ratcheting knuckle, which often results in wrinkling or creasing of the screen as the screen is tightened or loosened.

In order to achieve a smooth reflection surface for the screen that is void of wrinkled or non-uniform surfaces alternative securing mechanisms are disclosed herein.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification.

SUMMARY

The foregoing needs are satisfied by the present disclosure, which provides for devices and methods for holographic screen suspension systems. The devices and methods provided can allow even and symmetric tension across the screen which can be used in entertainment and other setting to provide a unique visual display for an audience.

In some embodiments, a system can include a main structure, a screen brace configured to couple to a screen, and a plurality of rod engagement mechanisms, where each rod engagement mechanism can include a threaded rod having a first end and a second end, a main structure bracket coupled to the main structure and having a wall positioned between the main structure and the screen brace, the wall having a hole therethrough configured to receive at least a portion of the first end of the threaded rod, said hole having at least a portion of the first end of the threaded rod passing therethrough, and a threaded nut engaged with the threaded rod between the first end and the wall of the main structure bracket and the second end of each threaded rod is coupled to the screen brace.

In some embodiments, a system can include a main structure, a screen brace configured to couple to a screen, and a plurality of rod engagement mechanisms, where each rod engagement mechanism can include a threaded rod having a first end and a second end, a screen brace bracket coupled to the screen brace and having a wall positioned between the main structure and the screen brace, the wall having a hole therethrough configured to receive at least a portion of the second end of the threaded rod, said hole having at least a portion of the second end of the threaded rod passing therethrough, and a threaded nut engaged with the threaded rod between the second end and the wall of the screen brace bracket and the first end of each threaded rod is coupled to the main structure.

In some embodiments, a system can include a main structure, a screen brace configured to couple to a screen, and a plurality of rod engagement mechanisms, where each rod engagement mechanism can include a first threaded rod having a first end and a second end, a second threaded rod having a first end and a second end, and a female/female nut operatively connected to the second end of the first threaded rod and the first end of the second threaded rod, where the first end of the first threaded rod is coupled to the main structure and the second end of the second threaded rod is coupled to the screen brace.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

BRIEF DESCRIPTION OF THE DRAWINGS

The devices and methods of the present disclosure can be described in conjunction with the appended drawings which are provided to illustrate but not to limit the disclosed devices and methods. Like designations in the drawings denote like elements.

DETAILED DESCRIPTION

Figure 1:
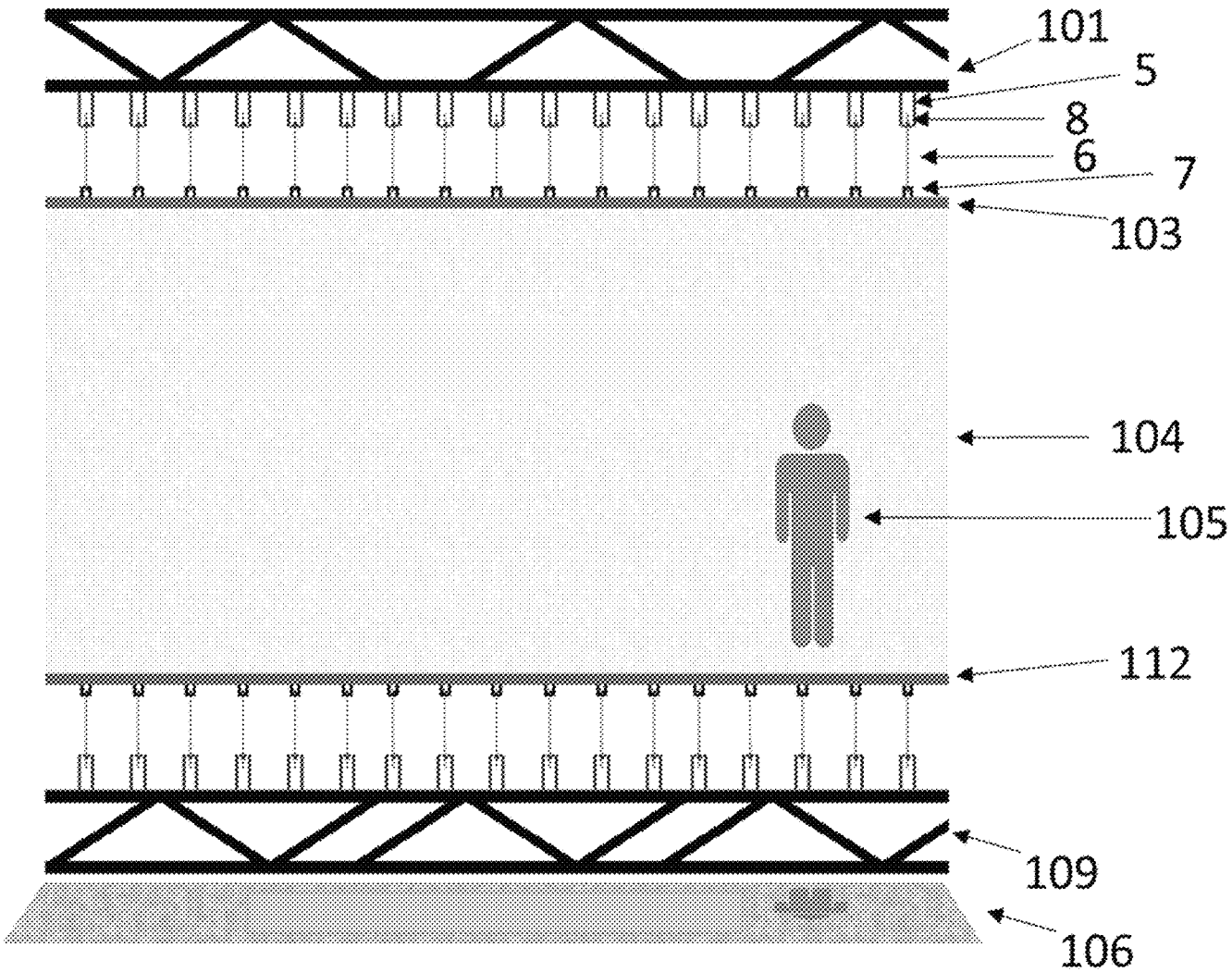
FIG. 1 depicts a front view of a holographic screen suspension system according to an exemplary embodiment.

The present disclosure provides devices and methods for holographic screen suspension systems.

Definitions

As used herein, the singular forms "a", "an" and "the" include plural referents unless the context clearly dictates otherwise.

The use of the term "or" in the claims and the present disclosure is used to mean "and/or" unless explicitly indicated to refer to alternatives only or the alternatives are mutually exclusive.

Use of the term "about", when used with a numerical value, is intended to include +/−10%. By way of example but not limitation, if a distance is identified as about 10 millimeters, this would include 9 to 11 millimeters (i.e., plus or minus 10%).

As used herein, the term "threaded rod" can refer to a rod having threads along the entire length of the rod or having threads at either or both ends but not along the entire length of the rod. By way of example, but not limitation, a "threaded rod" can have threading at both ends with a portion between the threaded ends that is not threaded.

Various aspects of the novel systems, apparatuses, and methods disclosed herein are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete and will fully convey the scope of the disclosure to those skilled in the art. Based on the teachings herein, one skilled in the art would appreciate that the scope of the disclosure is intended to cover any aspect of the novel systems, apparatuses, and methods disclosed herein, whether implemented independently of, or combined with, any other aspect of the disclosure. For example, an apparatus may be implemented, or a method may be practiced using any number of the aspects set forth herein. In addition, the scope of the disclosure is intended to cover such an apparatus or method that is practiced using other structure, functionality, or structure and functionality in addition to or other than the various aspects of the disclosure set forth herein. It should be understood that any aspect disclosed herein might be implemented by one or more elements of a claim.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, and/or objectives. The detailed description and drawings are merely illustrative of the disclosure rather than limiting, the scope of the disclosure being defined by the appended claims and equivalents thereof.

The devices and methods of the present disclosure, including the exemplary embodiments disclosed herein, are directed to systems for securely engaging a screen.

In some embodiments, a system can include a main structure, a screen brace configured to couple to a screen, and a plurality of rod engagement mechanisms, where each rod engagement mechanism can include a threaded rod having a first end and a second end, a main structure bracket coupled to the main structure and having a wall positioned between the main structure and the screen brace, the wall having a hole therethrough configured to receive at least a portion of the first end of the threaded rod, said hole having at least a portion of the first end of the threaded rod passing therethrough, and a threaded nut engaged with the threaded rod between the first end and the wall of the main structure bracket and the second end of each threaded rod is coupled to the screen brace.

In some embodiments, a system can include a main structure, a screen brace configured to couple to a screen, and a plurality of rod engagement mechanisms, where each rod engagement mechanism can include a threaded rod having a first end and a second end, a screen brace bracket coupled to the screen brace and having a wall positioned between the main structure and the screen brace, the wall having a hole therethrough configured to receive at least a portion of the second end of the threaded rod, said hole having at least a portion of the second end of the threaded rod passing therethrough, and a threaded nut engaged with the threaded rod between the second end and the wall of the screen brace bracket and the first end of each threaded rod is coupled to the main structure.

In some embodiments, a system can include a main structure, a screen brace configured to couple to a screen, and a plurality of rod engagement mechanisms, where each rod engagement mechanism can include a first threaded rod having a first end and a second end, a second threaded rod having a first end and a second end, and a female/female nut operatively connected to the second end of the first threaded rod and the first end of the second threaded rod, where the first end of the first threaded rod is coupled to the main structure and the second end of the second threaded rod is coupled to the screen brace.

According to some example embodiments, a system of the present disclosure can include a metal rod system, also referred to herein as a "rod engagement mechanism" that mechanically connects the main structure to the screen brace. The rod can attach to two opposing brackets, one on the main structure and the other on the screen brace. The two mentioned brackets can differ by one being a simple attachment point for the rod, without much adjustability needed, and the other bracket allowing a threaded nut to thread on the rod, for example, inside the main structure bracket.

As the threaded nut is turned and moves along the threaded rod toward the screen if it is in the main structure bracket or away from the screen if it is in the screen brace bracket, it will eventually be obstructed by the interior wall of the bracket. Once the threaded nut hits the interior wall, it will begin to force the threaded rod to move into the interior of the bracket, pulling the rest of the assembly (i.e., screen brace, holographic or transparent screen and screen brace bracket) towards the main structure. The resulting effect being that as the nut is tightened or loosened, the distance and/or contracting pressure of the main structure bracket and the screen brace bracket changes, which results in tension applied to the holographic foil. Each rod assembly component such as, main structure bracket, threaded rod and threaded nut, can be independently adjusted as needed.

One skilled in the art would appreciate that holographic foil may have issues of wrinkling as tension is applied to it. With independent adjustability, a technician can adjust each assembly until all or most wrinkles are gone from the screen. One skilled in the art would appreciate that the devices and methods of the present disclosure are directed to attaching and tensioning the holographic foil.

Referring to FIG. 1, an illustrative example of a front view of a holographic screen suspension system 100 according to an example embodiment is shown. The holographic screen suspension system 100 includes a first main structure 101, a first plurality of rod engagement mechanisms which include a main structure bracket 5, a threaded rod 6, a screen brace bracket 7 and a threaded nut 8, screen brace 103, transparent screen 104, and bounce screen 106. In addition, holographic screen suspension system 100 includes a different second main structure 109, and a second plurality of rod engagement mechanisms and a second screen brace 112, where the second plurality of rod engagement mechanisms and second main structure 109 are opposite the first main structure 101 and first plurality of rod engagement mechanisms 102. Also depicted is a projected image or hologram 105.

Figure 2:
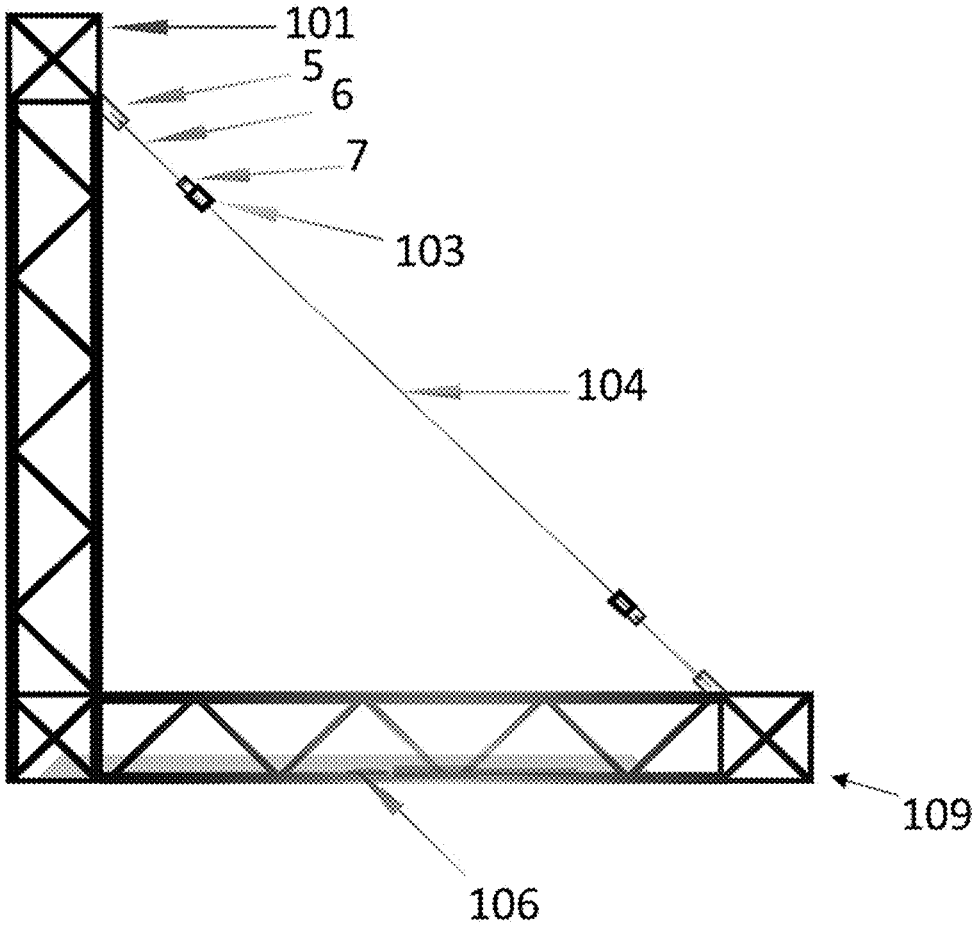
FIG. 2 depicts a side view of the holographic screen suspension system according to an exemplary embodiment as shown in FIG. 1.

Next, referring to FIG. 2, a side view of the holographic screen suspension system according to the exemplary embodiment of FIG. 1 is provided. The main structure 101 is coupled to a road engaging mechanism that includes the main structure bracket 5, threaded nut (not shown), threaded rod 6, and a screen brace bracket 7 that is coupled to the screen brace 103 which, in turn is coupled to the transparent screen 104. The transparent screen 104 is also attached to the second main structure 109 by a second rod engagement mechanism. The system further includes a bounce screen 106 to reflect an image on the transparent screen 104. As can be understood, the threaded nuts of the respective rod engagement mechanisms can be tightened or loosened to achieve tension on the transparent screen 104 to reduce wrinkling and provide a uniform surface for the effect.

Figure 3:
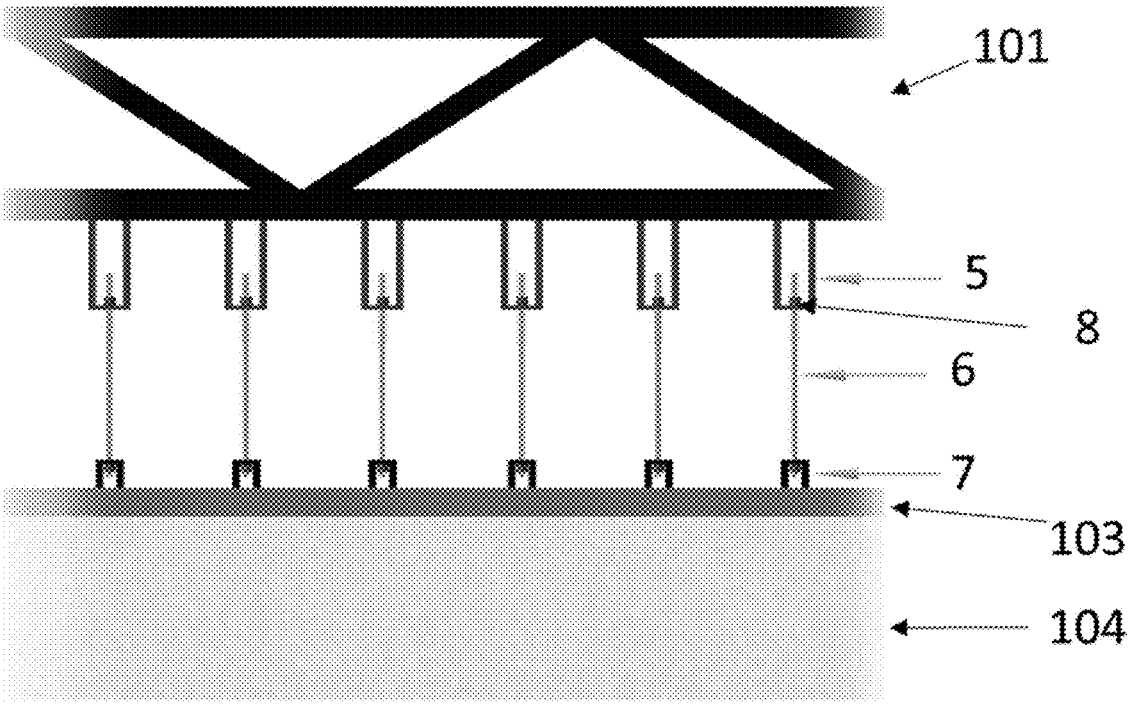
FIG. 3 depicts a view of a portion of the holographic screen suspension system according to the exemplary embodiment of FIG. 1.

As shown in FIG. 3, which shows a portion of the holographic screen suspension system of FIG. 1, the main structure bracket 5 can be coupled to the main structure 101 with the threaded rod 6 passing through a hole in the wall of the main structure bracket 5 that is between the main structure 101 and the screen brace 103 with a threaded nut 8 engaged to the threaded rod, and a screen brace bracket 7 coupling the assembly to the screen brace 103 which is coupled to the transparent screen 104.

Figure 4:
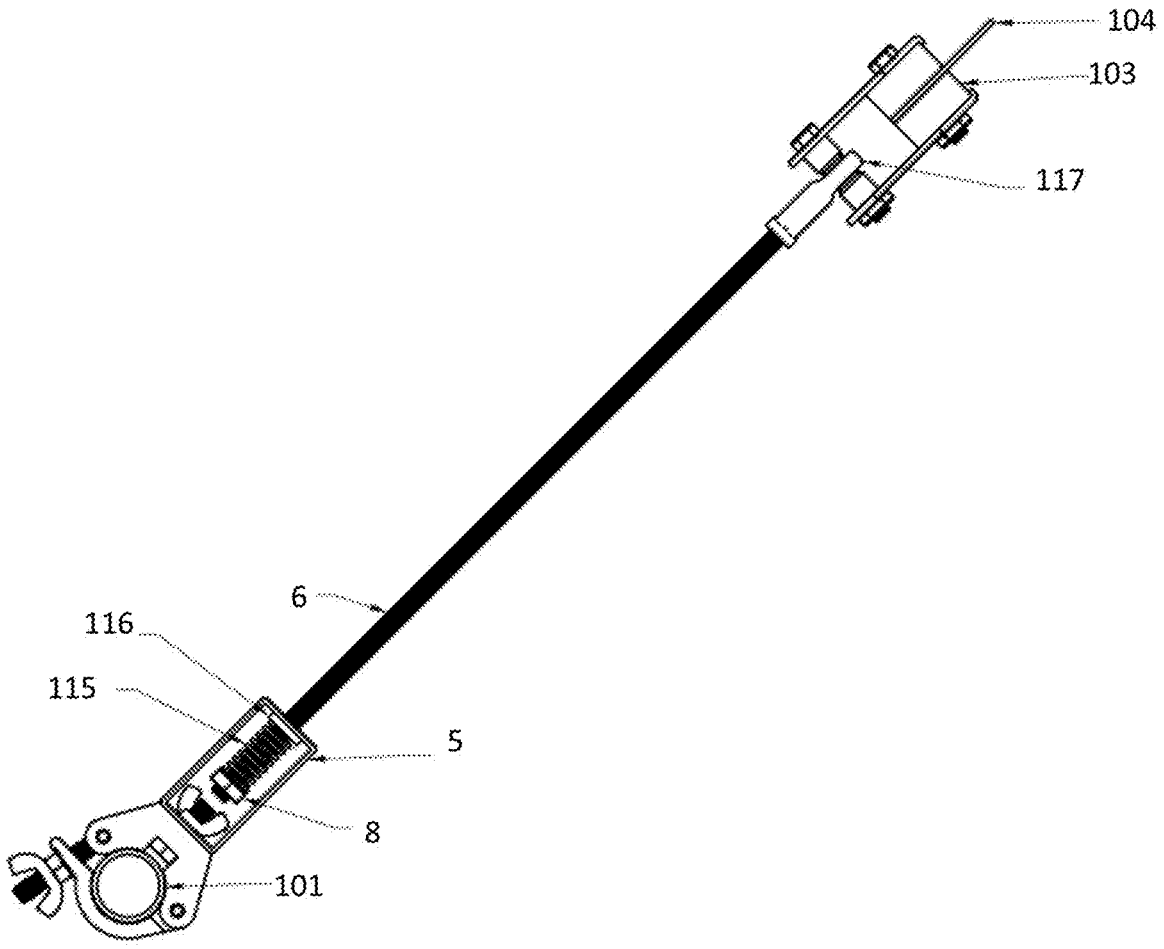
FIG. 4 depicts a rod engagement mechanism of an exemplary embodiment.

FIG. 4 depicts an exemplary rod engagement mechanism whereby the main structure 101, in this case a stage truss/tube, can be coupled to the main structure bracket 5 which includes the threaded nut 8 engaged to the threaded rod 6 within the structure of the bracket. The mechanism further includes a spring/bushing 115 and a bushing 116. At the opposing end of the rod, the threaded rod 6 is coupled to the screen brace 103 by a ball joint 117 and the transparent screen 104 is sandwiched in the screen brace 104.

Figure 5:
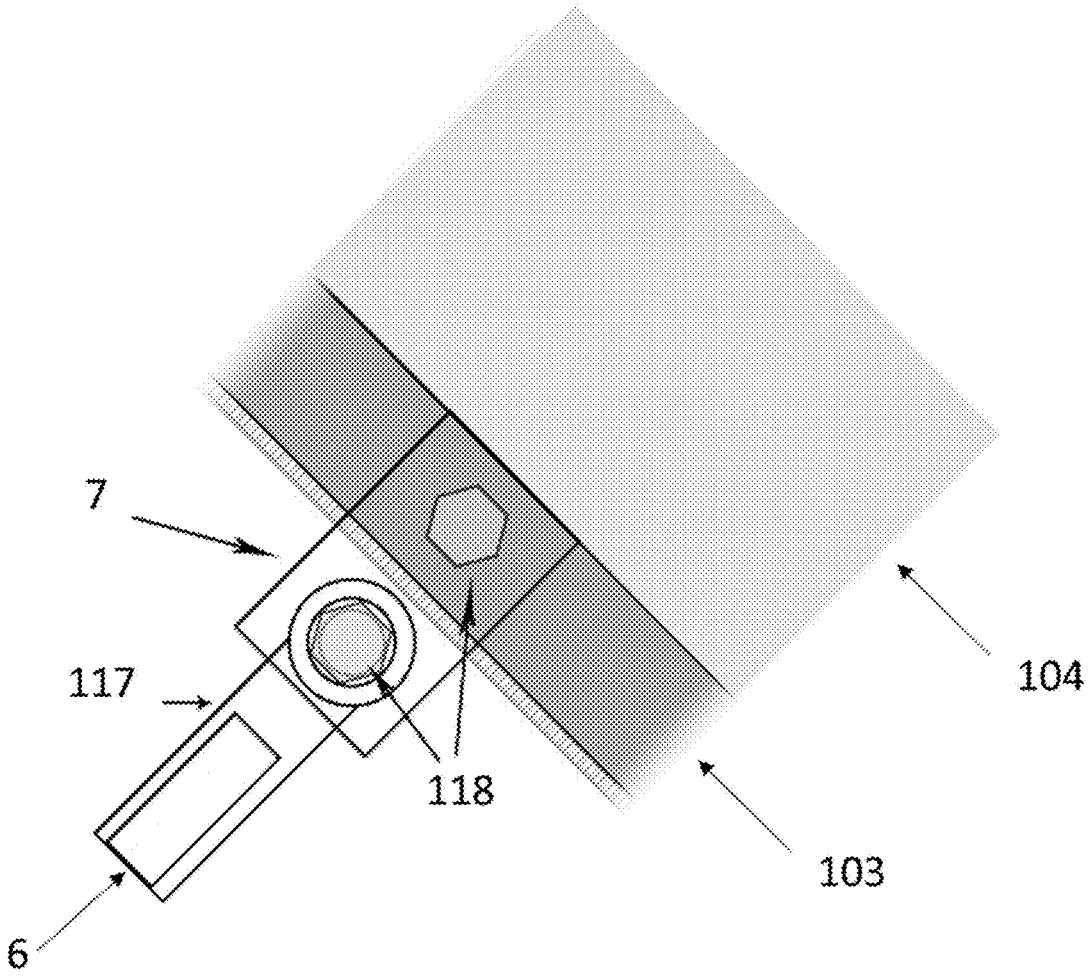
FIG. 5 depicts a portion of a rod engagement mechanism of an exemplary embodiment.
Figure 6:
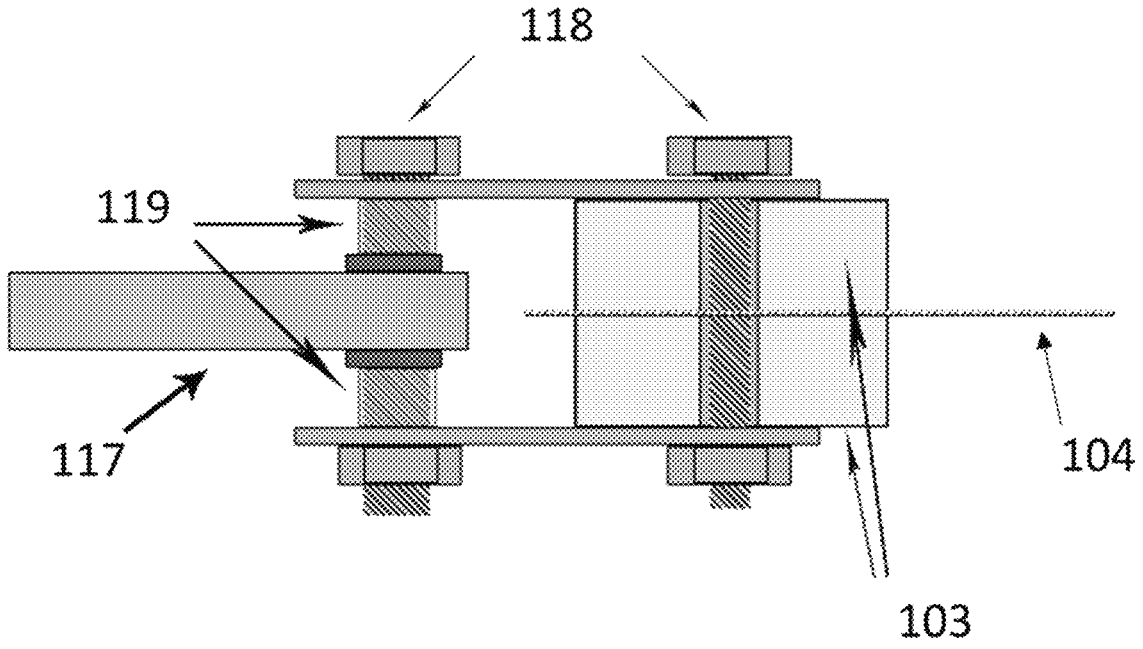
FIG. 6 depicts a side view of the portion of a rod engagement mechanism of the exemplary embodiment of FIG. 5.

FIG. 5 likewise depicts a portion of an exemplary rod engagement mechanism where the threaded rod 6 can be screwed into a bolt that includes a ball joint 117 and is part of the screen brace bracket 7 which is coupled to the screen brace 103 which is coupled to the transparent screen 104. Bolts 118 can secure the ball joint 117 and the screen brace bracket 7. Similarly, FIG. 6 shows where the ball joint 117 can be attached with spacer 119 and affixed by bolts 118 and to the screen brace 103 which is coupled to the transparent screen 104.

In an alternative embodiment of the rod engagement mechanism, the rod engagement mechanism can include a first threaded rod and a second threaded rod, the first threaded rod being coupled to the main structure and the second threaded rod being coupled to the screen brace. The two ends distal from the main structure and screen brace, respectively, can be engaged with a female/female nut or long threaded nut. In this way, the long threaded nut can connect both ends of the rods and be turned in order to adjust the distance of the main structure and screen brace. In some embodiments, the rod engagement mechanism can include more than two threaded rods connected by female/female nuts or long threaded nuts. In some embodiments, only one of the threaded rods can be threaded and the other(s) can lack threads, provided that the two can be coupled by a screw-type mechanism. By way of example, but not limitation, the first threaded rod can be coupled to a second rod where the coupling is by way of the first threaded rod engagement with the second rod in a screw-type manner. For example, the second rod can have a threaded recess for receiving the first threaded rod.

Figure 7:
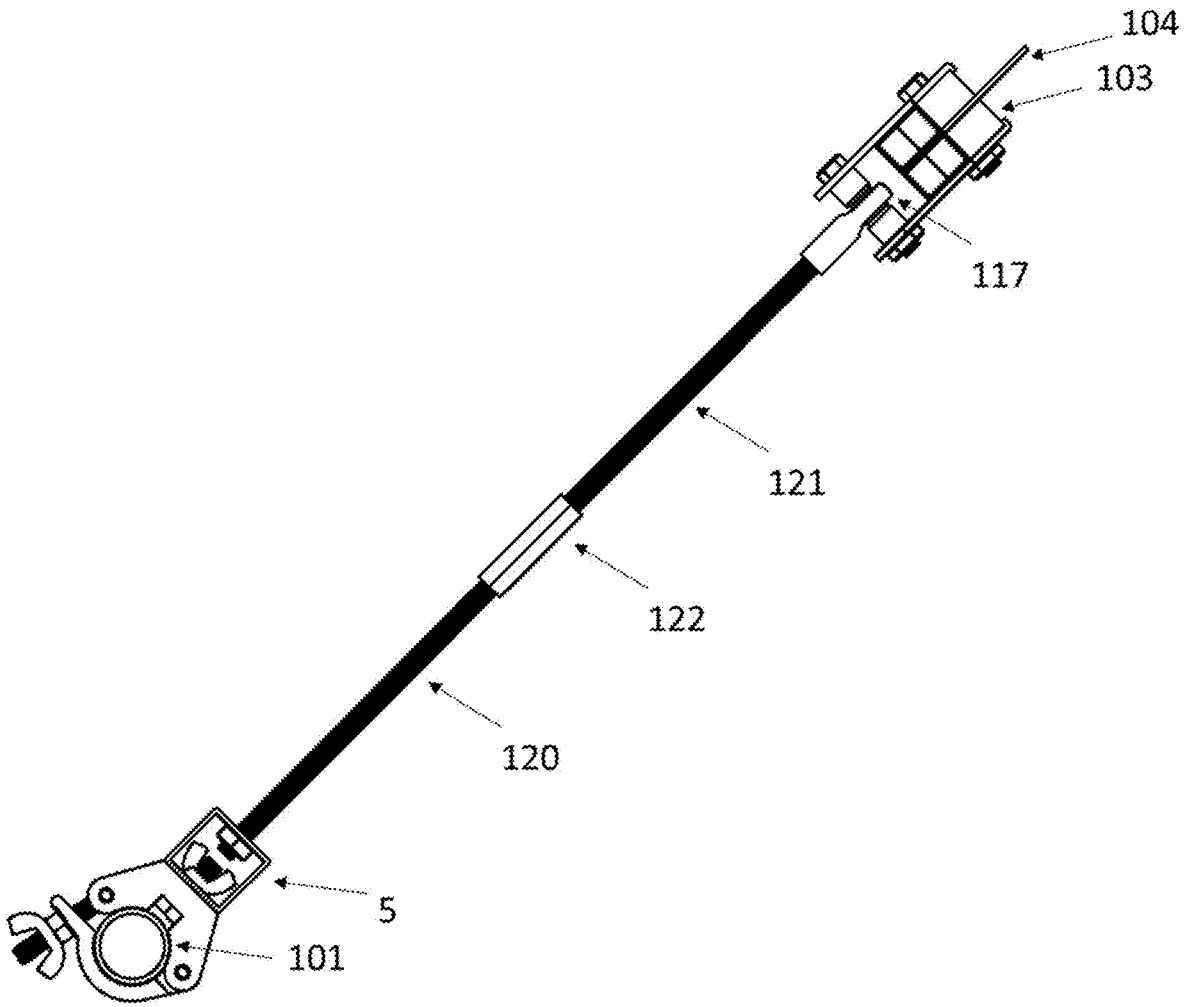
FIG. 7 depicts a rod engagement mechanism of an exemplary embodiment.
Figure 8:
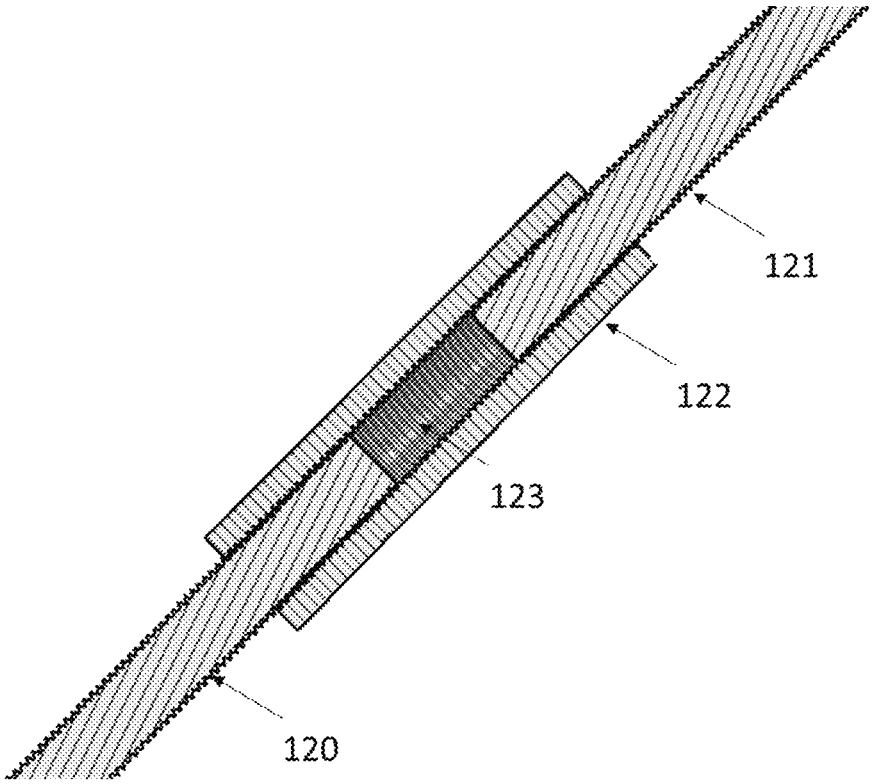
FIG. 8 depicts a close up view of the female/female nut or long threaded nut engaged with the first threaded rod and the second threaded rod.

As shown in FIG. 7, which shows an exemplary embodiment, the first threaded rod 120 can be coupled to the main structure 101 by the main structure bracket 5. The other end of the first threaded rod 120 can be engaged with the female/female nut or long threaded nut 122. The second threaded rod 121 can be coupled to the screen brace 103 by a connection that includes a ball joint 117 with the other end of the second threaded rod 121 engaged with the female/female nut or long threaded nut 122. The screen brace is also coupled to the transparent screen 104. FIG. 8, which shows a close up view of the connection between the first threaded rod and second threaded rod shows that the first threaded rod 120 can be engaged with the female/female nut or long threaded nut 122 by threading it into at least a portion of one end of the female/female nut or long threaded nut 122 and that the second threaded rod 121 can be engaged with the other end of the female/female nut or long threaded nut 122 by threading it into at least a portion of that end. As shown, there can be a gap 123 between the ends of the first and second threaded rods 120, 121 that lies within the female/female nut or long threaded nut 122.

It should be understood that the configuration of the rod engagement mechanism can be changed such that the screen brace bracket includes the hole for the threaded rod to pass through and a where the threaded nut can be engaged with the second end of the rod. Thus, rather than being able to adjust tension by tightening the threaded nut at the main stage bracket, it can be adjusted at the screen brace bracket. It should likewise be understood that different combinations of these configurations can be combined. For example, at the top of the screen where a first screen brace can couple to the screen, there can be one rod engagement mechanism configuration or a combination thereof, and at the bottom of the screen where a second screen brace can couple to the screen there can be a different or the same rod engagement mechanism configurations.

In any of the foregoing embodiments, the plurality(ies) of rod engagement mechanisms can be aligned in series along the main structure or screen brace.

In any of the foregoing embodiments a ball joint can pivotally attach a threaded rod to the main structure bracket or the screen brace bracket.

In any of the foregoing embodiments, the system can include more than one plurality of rod engagement mechanisms where each plurality of rod engagement mechanism is positioned on another main structure. In such embodiments, the other main structures can be connected to the main structure. By way of example, but not limitation, a system of the present disclosure can include up to 4 pluralities of rod engagement mechanisms with each plurality connected to a screen brace on one of four sides of the screen. Different types of rod engagement mechanisms can be combined and can vary within the plurality of rod engagement mechanisms and between different pluralities of rod engagement mechanisms.

In any of the foregoing embodiments where the threaded rod is engaged with a threaded nut that is within a bracket, the rod engagement mechanism can further include a spring/bushing or bushing positioned between the threaded nut and the wall of the bracket to provide more or additional constant tension and/or vibration reduction.

It should be understood that coupling of the components of the systems of the present disclosure can be achieved using known devices and configurations such as direct attachment or intermediary attachment devices.

Advantages of the systems provided in the present disclosure are that micro-adjustments can be made which can achieve clearer results from the screen. In addition, systems of the present disclosure can reduce vibration in sound heavy environments.

Main Structures

The main structure 101 can support and hold up the screen and tensioning system. In any of the foregoing embodiments, the main structure (including the first or second main structure) can be any suitable structure for suspension of a screen. In any of the foregoing embodiments, the main structure (including the first or second main structure) can be a truss/stage system. In any of the foregoing embodiments, the main structure (including the first of second main structure) can be a building support system or frame. In some embodiments, the building support system or frame can be made from metal, wood or plastic. In some embodiments, a main structure can be a stage. For example, a screen brace can be attached to a stage.

In any of the foregoing embodiments, the main structure or screen brace can be connected to the threaded rod(s) by an intermediary attachment device, such as a truss clamp. In any of the foregoing embodiments, the main structure bracket can include a 2"×4" aluminum rectangular tube cut with a width of 2" with an open ID indicated labeled thereon. In such an embodiment, the one end of the main structure bracket can be attached either directly to the main structure or with an intermediary attachment device (such as a truss clamp) and the opposing end can include the hole for the threaded rod to enter the void of the main structure.

Screen Braces

In any of the foregoing embodiments, the screen brace (including the first or second screen brace) can provide attachment points for the suspension system and can hold the screen or holographic foil. In some embodiments, the screen brace can include two metal rectangular tubes between which the screen or foil can be sandwiched and that apply significant pressure between the tubes to hold the screen during tension.

Rod Engagement Mechanisms

In any of the foregoing embodiments, the system can include two or more rod engagement mechanisms. By way of example, but not limitation, the system can include at least 2, 3, 4, 5, 6, 7, 8, 9, 10, 11, 12, 13, 14, 15, 16, 17, 18, 19, 20, 25, 30, 40, 50, 60, 70, 80, 90, 100 or more rod engagement mechanisms in each plurality of rod engagement mechanisms. By way of further example, but not limitation, a plurality of rod engagement mechanisms can include 2-10, 5-10, 5-25, 5-50, 5-100, 10-20, 10-50, 10-100, 20-30, 20-40, 20-50, 20-100, 30-40, 30-50, 30-100, 40-50, 40-100, 50-100, 60-100, 70-100, 80-100, or 90-100 rod engagement mechanisms.

Screens

In any of the foregoing embodiments, the system can further include a screen. In some embodiments, the screen can be coupled to the screen brace. In some embodiments, the screen can be coupled to the first screen brace and second screen brace. In some embodiments, the screen can be a holographic foil. The holographic foil can be a material that is capable of reflecting an image from a bounce screen or image source. In some embodiments, the holographic foil is made of a semi- or near-transparent foil. In some embodiments, the holographic foil can be transparent mylar, clear plastic or a transparent crystallized material.

Bounce Screens/Image Sources

In any of the foregoing embodiments, the system can further include a bounce screen. In some embodiments, the bounce screen can be positioned at a 45° angle relative to screen. By way of example, the bounce screen can be positioned at an angle relative to the screen of from about 0° to about 90°, about 10° to about 80°, about 20° to about 70°, about 30° to about 60°, about 40° to about 50°, about 10°, 20°, 30°, 40°, 50°, 60°, 70°, 80° or 90°. One skilled in the art would appreciate that such angle may be increased or decreased in order to achieve the desired image reflection. When in this configuration, the reflected image on the holographic foil appears to be suspended in 3D (three-dimensional) space to the audience. In some embodiments, the system can include a bounce screen and an image source.

In any of the foregoing embodiments, the system can further include an image source that is configured to provide the source image such that reflection off of the screen or holographic foil is achieved. By way of example, but not limitation, the image source can be one or more projectors configured to project onto a bounce screen, such as LED, LCD (liquid crystal display), and OLED (organic light-emitting diode) type displays. In some embodiments, a physical object can be illuminated and the screen or holographic foil will reflect the image of the physical object. By way of example, but not limitation, the physical object can be a person.

Methods

In some embodiments, a method for minimizing or eliminating wrinkles in a screen can include the steps of providing a system of the present disclosure according to any of the foregoing embodiments which includes a screen. The method can further include adjusting at least one rod engagement mechanism by rotating the threaded nut therein.

While the above detailed description has shown, described, and pointed out novel features of the disclosure as applied to various implementations, it will be understood that those skilled in the art may make various omissions, substitutions, and changes in the form and details of the device or process illustrated without departing from the disclosure. The foregoing description is of the best mode presently contemplated of carrying out the disclosure. This description is in no way meant to be limiting, but rather should be taken as illustrative of the general principles of the disclosure. The scope of the disclosure should be determined with reference to the claims.

While the disclosure has been illustrated and described in detail in the drawings and foregoing description, such illustration and description are to be considered illustrative or exemplary and not restrictive. The disclosure is not limited to the disclosed embodiments. Variations to the disclosed embodiments and/or implementations may be understood and effected by those skilled in the art in practicing the claimed disclosure, from a study of the drawings, the disclosure and the appended claims.

It should be noted that the use of particular terminology when describing certain features or aspects of the disclosure should not be taken to imply that the terminology is being re-defined herein to be restricted to include any specific characteristics of the features or aspects of the disclosure with which that terminology is associated. Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "comprising" as used herein is synonymous with "including," "containing," or "characterized by," and is inclusive or open-ended and does not exclude additional, un-recited elements or method steps; the term "having" should be interpreted as "having at least;" the term "such as" should be interpreted as "such as, without limitation;" the term 'includes" should be interpreted as "includes but is not limited to;" the term "example" is used to provide exemplary instances of the item in discussion, not an exhaustive or limiting list thereof, and should be interpreted as "example, but without limitation;" adjectives such as "known," "normal," "standard," and terms of similar meaning should not be construed as limiting the item described to a given time period or to an item available as of a given time, but instead should be read to encompass known, normal, or standard technologies that may be available or known now or at any time in the future; and use of terms like "preferably," "preferred," "desired," or "desirable," and words of similar meaning should not be understood as implying that certain features are critical, essential, or even important to the structure or function of the present disclosure, but instead as merely intended to highlight alternative or additional features that may or may not be utilized in a particular embodiment. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Also, as used herein "defined" or "determined" may include "predefined" or "predetermined" and/or otherwise determined values, conditions, thresholds, measurements, and the like.

What is claimed is:

1. A system for securely engaging a screen, comprising: a main structure; a screen brace configured to couple to a screen; a plurality of rod engagement mechanisms, each rod engagement mechanism comprising: a threaded rod having a first end and a second end, a main structure bracket coupled to the main structure and having a wall positioned between the main structure and the screen brace, the wall having a hole therethrough configured to receive at least a portion of the first end of the threaded rod, said hole having at least a portion of the first end of the threaded rod passing therethrough, and a threaded nut engaged with the threaded rod between the first end and the wall of the main structure bracket, wherein the second end of each threaded rod is coupled to the screen brace; wherein each rod engagement mechanism further comprises a bushing or spring positioned between the threaded nut and the wall of the main structure bracket and around the threaded rod; and further comprising a screen coupled to the screen brace.

2. The system of claim 1, further comprising a bounce screen configured to be at an angle relative to the screen.

3. The system of claim 2, wherein the angle is 45°.

4. The system of claim 1, further comprising a plurality of screen brace brackets, wherein the second end of each threaded rod is coupled to the screen brace by one of the screen brace brackets.

5. The system of claim 1, wherein the second end of at least one of the threaded rods is coupled to the screen brace by a ball-joint, whereby the at least one of the threaded rods can pivot relative to the screen brace.

6. A system for securely engaging a screen, comprising: a main structure; a screen brace configured to couple to a screen; a plurality of rod engagement mechanisms, each rod engagement mechanism comprising: a threaded rod having a first end and a second end, a screen brace bracket coupled to the screen brace and having a wall positioned between the main structure and the screen brace, the wall having a hole therethrough configured to receive at least a portion of the second end of the threaded rod, said hole having at least a portion of the second end of the threaded rod passing therethrough, and a threaded nut engaged with the threaded rod between the second end and the wall of the screen brace bracket, wherein the first end of each threaded rod is coupled to the main structure, wherein each rod engagement mechanism further comprises a bushing or spring positioned between the threaded nut and the wall of the main structure bracket and around the threaded rod, and further comprising a screen coupled to the screen brace.

7. The system of claim 6, further comprising a bounce screen configured to be at an angle relative to the screen.

8. The system of claim 7, wherein the angle is 45°.

9. The system of claim 6, further comprising a plurality of main structure brackets, wherein the first end of each threaded rod is coupled to the main structure by one of the main structure brackets.

10. The system of claim 6, wherein the first end of at least one of the threaded rods is coupled to the main structure by a ball-joint whereby the at least one of the threaded rods can pivot relative to the main structure.

11. A system for securely engaging a screen, comprising: a main structure; a screen brace configured to couple to a screen; a plurality of rod engagement mechanisms, each rod engagement mechanism comprising: a first threaded rod having a first end and a second end, a second threaded rod having a first end and a second end, a female/female nut or threaded nut operatively connected to the second end of the first threaded rod and the first end of the second threaded rod, wherein the first end of the first threaded rod is coupled to the main structure, and wherein the second end of the second threaded rod is coupled to the screen brace, further comprising a screen coupled to the screen brace.

12. The system of claim 11, further comprising a bounce screen configured to be at an angle relative to the screen.

13. The system of claim 12, wherein the angle is 45°.

14. The system of claim 11, wherein the first end of at least one of the first threaded rods is coupled to the main structure by a ball-joint or the second end of at least one of the second threaded rods is coupled to the screen brace by a ball-joint, whereby the at least one of the first threaded rods can pivot relative to the main structure or the at least one of the second threaded rods can pivot relative to the screen brace, respectively.

* * * * *